US006875474B2

(12) United States Patent
Kohl et al.

(10) Patent No.: US 6,875,474 B2
(45) Date of Patent: Apr. 5, 2005

(54) ELECTROLESS COPPER PLATING SOLUTIONS AND METHODS OF USE THEREOF

(75) Inventors: Paul A. Kohl, Atlanta, GA (US); Jun Li, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 10/288,744

(22) Filed: Nov. 6, 2002

(65) Prior Publication Data

US 2004/0086656 A1 May 6, 2004

Related U.S. Application Data

(60) Provisional application No. 60/332,859, filed on Nov. 6, 2001.

(51) Int. Cl.[7] ..... B05D 1/18

(52) U.S. Cl. ..... 427/437; 427/443.1; 106/1.18; 106/1.23

(58) Field of Search ..... 427/437, 443.1; 106/1.18, 1.23

(56) References Cited

U.S. PATENT DOCUMENTS

| | | | | | |
|---|---|---|---|---|---|
| 3,716,462 | A | * | 2/1973 | Jensen | 205/180 |
| 4,908,242 | A | * | 3/1990 | Hughes et al. | 427/443.1 |
| 5,770,032 | A | * | 6/1998 | Cane | 205/210 |
| 5,801,100 | A | * | 9/1998 | Lee et al. | 438/678 |
| 6,165,912 | A | * | 12/2000 | McConnell et al. | 438/758 |

* cited by examiner

*Primary Examiner*—Michael Cleveland
(74) *Attorney, Agent, or Firm*—Thomas, Kayden, Horstmeyer & Risley, LLP

(57) ABSTRACT

Electroless copper plating solutions and methods of use thereof are disclosed. A representative electroless copper plating solution includes a reducing agent that is a source of hypophosphite ions and at least one accelerator compound that accelerates the rate of copper deposition.

21 Claims, 9 Drawing Sheets

ELECTROLESS COPPER PLATING SOLUTIONS AND METHODS OF USE THEREOF

CROSS-REFERENCE TO RELATED APPLICATION

This application claims priority to copending U.S. provisional patent application entitled "Improved Electroless Copper Plating Solution" filed on Nov. 6, 2001 and accorded Ser. No. 60/332,859, which is entirely incorporated herein by reference.

TECHNICAL FIELD

The present invention is generally related to electroless copper plating solutions and, more particularly, is related to nonformaldehyde electroless copper plating solutions and methods of use thereof.

BACKGROUND OF THE INVENTION

Electroless plating includes chemically reducing metal ions in an electroless plating solution onto a conductive or non-conductive surface without supplying any electric current from the outside. Electroless plating is widely used in nickel-phosphorus deposition, nickel-boron deposition, and a copper deposition. In particular, electroless copper plating can be used to form a copper film onto substrates in the fabrication of printing circuit boards and other electronic devices. Electroless copper plating is widely used because the deposition process is simple and the copper film is highly conductive.

Electroless plating can be accomplished either by immersion electroless systems or by spray electroless systems. In immersion electroless plating systems, the surface to be coated is immersed in the electrolyte bath. The reduction reaction is catalyzed by the seed layer, thereby increasing the metal thickness. By comparison, the electrolyte solution is sprayed over the object in spray electroless plating systems.

Electroless plating involves the formation of a thin film of material (i.e., a metal such as copper) from an electroless plating solution without external electric current. The electroless plating solution usually contains metal ions, a metal ion complexing agent, a reducing agent for reducing the metal ion to deposit the metal, and a pH buffer. In addition, the electroless plating solution may contain a stabilizer for improving the stability of the electroless plating solution, and a surfactant for improving the properties of the metal film.

Electroless plating occurs by two simultaneous half reactions involving electron generation and electron reduction. The metal cations in the solution accept electrons at the deposition surface, become reduced, and are deposited as metal on the surface of the substrate.

A catalytic surface usually consists of either a surface which has been activated, for instance with palladium-tin colloid, or a thin evaporated or sputtered seed of a noble metal like gold, platinum or palladium. Once a thin layer of metal has been deposited onto the seed layer or sensitized surface, electroless plating continues autocatalytically, since the metallic film is also a good catalyst for electroless growth.

However, electroless copper plating solutions typically use formaldehyde or its derivatives as reducing agents, which are volatile carcinogenic liquids. In addition, using formaldehyde requires that the electroless solution be operated at pH conditions of 11 or more. Thus, materials that are sensitive to higher (more basic) pH solutions cannot be used in electroless copper plating systems that include these types of chemicals in the electroless plating solutions.

Thus, a heretofore unaddressed need exists in the industry for a electroless solution that addresses the aforementioned deficiencies and/or inadequacies.

SUMMARY OF THE INVENTION

Embodiments of the present invention include electroless copper plating solutions and methods of use thereof. A representative electroless copper plating solution includes a reducing agent that is a source of hypophosphite ions and at least one accelerator compound that accelerates the rate of copper deposition.

In another embodiment, a representative method of using the electroless copper plating solution includes: providing a structure and providing a electroless copper plating solution. The electroless copper plating solution includes a reducing agent that is a source of hypophosphite ions and at least one accelerator compound that accelerates the rate of copper deposition. Subsequently, the structure is exposed to the electroless copper plating solution, and copper (II) ions are reduced onto the structure as a metal film.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following graphs.

FIG. 1A is a graph illustrating the deposition rate of a representative electroless copper plating solution containing thiourea, while

FIG. 2A is a graph illustrating the deposition of another representative electroless copper plating solution containing 1,3-diphenyl-2-thiourea, while

FIG. 6A is a graph illustrating the increase in thickness of the copper film over time using the electroless copper plating solution discussed in reference to FIG. 5, while

DETAILED DESCRIPTION OF THE PREFERRED EMBODIMENT

Figure 1A:
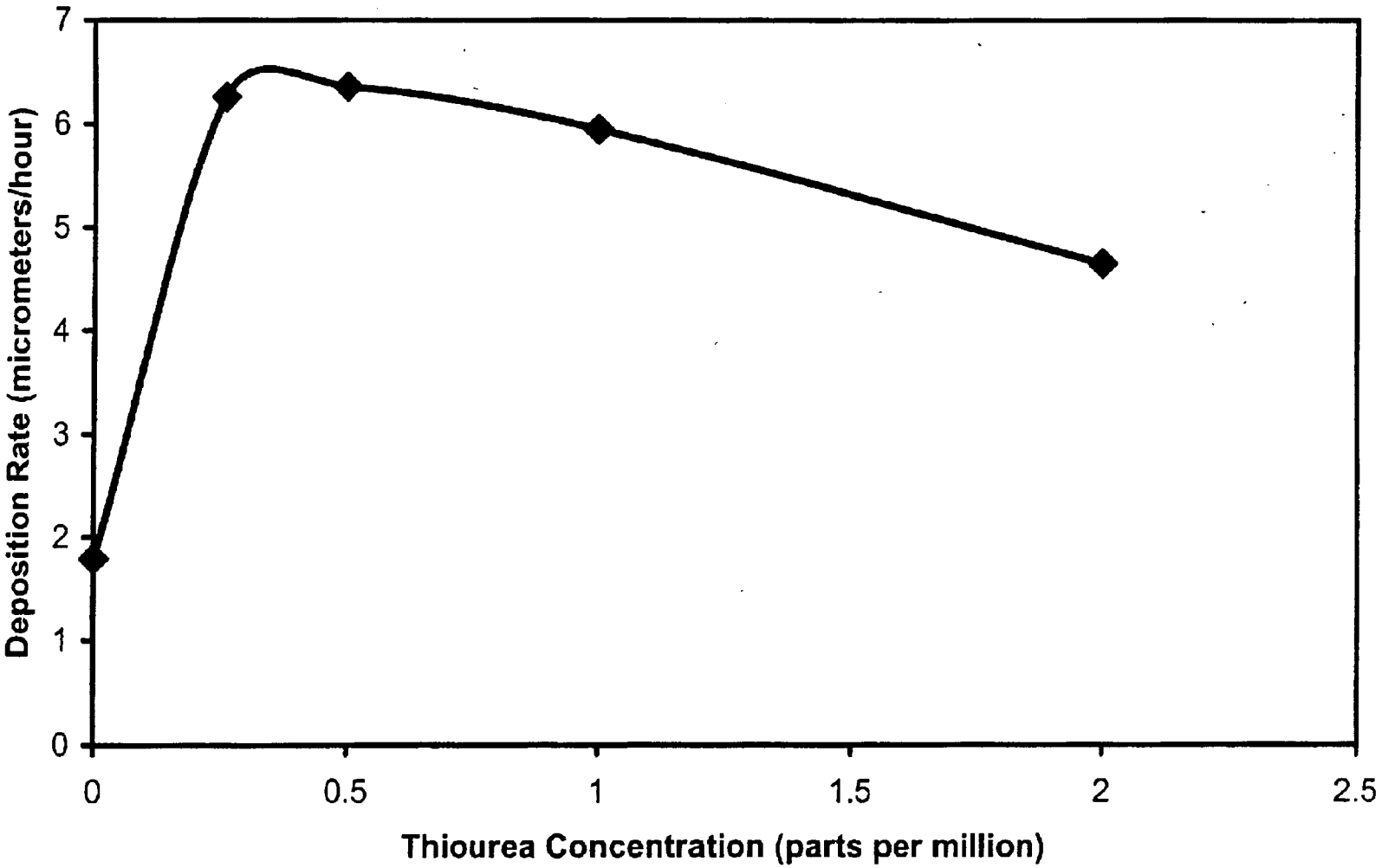

Embodiments of the present invention provide for electroless copper plating solutions and methods of use thereof.

The electroless copper plating solutions of the present invention include an accelerator (e.g., thiourea or formamidine disulfide dihydrochloride) compound that increases the deposition rate of the copper (II) ions into a copper metal film and a source of hypophosphite ions. The electroless copper plating solutions do not include formaldehyde or its derivatives as reducing agents, which are volatile carcinogenic liquids. In addition, the electroless copper plating solution can operate under pH conditions less than 11 (i.e., from a pH of about 8 to 10). Consequently, the electroless copper plating solutions of the present invention can be compatible with low-k dielectric or photoresist materials. Furthermore, the electroless copper plating solution of the present invention can be used to form copper films having resistivities from about $2\times10^{-6}$ to $5\times10^{-6}$ ohm cm.

Embodiments of the present invention include electroless copper plating solutions that include a reducing agent (e.g., a source of hypophosphite ions) and at least one accelerator compound that accelerates the rate of copper deposition. In addition, the electroless copper plating solution can include copper-containing compound (e.g., a source of copper (II) ions), at least one copper ion complexing agent, a pH buffer (e.g., boric acid), a surface active agent, and a nickel-containing compound or a cobalt-containing composition (e.g., a source of nickel ions).

The copper-containing compounds can include compounds that dissociate to produce copper (II) ions. The copper containing compounds can include, but are not limited to, copper sulfate, copper chloride, copper nitrate, copper oxide, and combinations thereof. The preferred copper-containing compound is copper sulfate. The concentration of the copper-containing compound is from about 0.008 M to 0.072 M, about 0.02 M to 0.06 M, and preferably about 0.04 M.

The reducing agent can include compounds that dissociate to produce hypophosphite ions. The reducing agent can include, but is not limited to, hypophosphite salts and combinations thereof. The preferred reducing agent is sodium hypophosphite. The concentration of the reducing agent is from about 0.06 M to 0.45 M, about 0.08 M to 0.16 M, and preferably about 0.12 M.

The copper ion complexing agents can include compounds that complex with copper (II) ions. The copper ion complexing agent can include, but is not limited to, (N-(2-hydroxyethyl)ethylenediaminetriacetic acid salts (HEDTA), sodium citrate, tartrate salts, gluconate salts, salicylic acid, pyrophosphate salts, malic acid, and combinations thereof. The concentration of the copper ion complexing agent is from about 0.01 M to 0.132 M, and preferably is from about 0.015 M to 0.08 M. The preferred copper complex ion agents are the trisodium salt of HEDTA (about 0.015 M to 0.08 M) and sodium citrate (about 0.051 M).

The surface active agent can include, but is not limited to, one or more compounds of the polyoxoethylene series of surface active agents. In particular, the polyoxoethylene series of surface active agents can include, but is not limited to, polyethylene glycol. The concentration of surface active agent is from about 100 parts per million to 1 gram/liter (g/L).

The accelerator compound can include compounds or combinations thereof that accelerate the electroless deposition of copper (II) ions. In particular, the electroless deposition includes the deposition of copper (II) ions onto a substrate (discussed below). The accelerator compound can include, but is not limited to, compounds represented by the following structure:

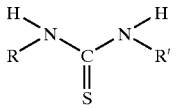

where R and R' can be selected from hydrogen, aryl groups, alkyl groups, and aliphatic groups. In addition, the accelerator compound can include, but is not limited to, thiourea, thionicotinamide, 2-imino-4-thiobiurea, 2,5-dithibiurea, 1,3-diphenyl-2-thiourea, other thiourea derivatives and combinations thereof. Furthermore, the accelerator compound can include, but is not limited to, formamidine disulfide dihydrochloride, formamidine acetate, and combinations thereof. Formamidine disulfide (fd) is an oxidized product of thiourea. The concentration of accelerator compound is from about 0.5 parts per million to 250 parts per million. The preferred accelerator compounds are thiourea (about 0.5 parts per million and 250 parts per million), 1,3-diphenyl-2-thiourea (about 0.5 parts per million and 4.0 parts per million), formamidine disulfide (about 0.5 parts per million to 250 parts per million), formamidine acetate (about 0.5 parts per million to 250 parts per million), and combinations thereof.

The nickel-containing compound can include compounds that dissociate to form a nickel ion. The nickel containing compound can include, but is not limited to, nickel sulfate, nickel hydroxide, nickel nitrate, nickel chloride, nickel oxide, nickel sulfamate tetrahydrate, and combinations thereof. The preferred nickel-containing compound is nickel sulfate. The concentration of nickel-containing compound is from about 0.1 to 2.5 g/L.

The buffer agent can include acids or bases that are capable of stabilizing the pH of the electroless copper plating solution during plating. For example, the buffer agent can include, but is not limited to, boric acid, ammonium sulfate, ammonium chloride, and triethanolamine. One skilled in the art can determine the amount of buffer agent necessary to stabilize the pH of the electroless copper plating solution to a pH from about 8 to 10 during plating.

Embodiments of the electroless copper plating solution can be used to form a copper film onto a structure. The structure can be incorporated into devices such as, but not limited to, printed wiring boards and integrated circuits.

In general, electroless deposition using the electroless copper plating solution of the present invention involves the formation of a thin film of copper without external electric current. The electroless deposition is due to two simultaneous oxidation-reduction reactions between the components of the electroless copper plating solution involving electron generation and electron reduction. The copper cations in the electroless copper plating solution accept electrons at the deposition surface, become reduced, and are deposited as copper film on the surface of the substrate.

The electroless copper plating solutions of the present invention can form copper films on the substrate at deposition rates of about 2 to 16 micrometers per hour and preferably about 2.8 to 7.2 micrometers per hour.

Figure 4C:
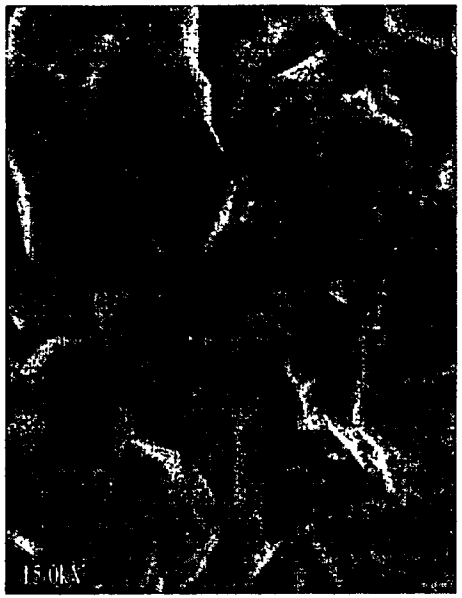
FIGS. 4A through 4C illustrate surface morphologies of copper films deposited with electroless copper plating solutions that do not have either thiourea or 1,3-diphenyl-2-thiourea (4A), have thiourea (4B), or have 1,3-diphenyl-2-thiourea (4C).
Figure 4B:
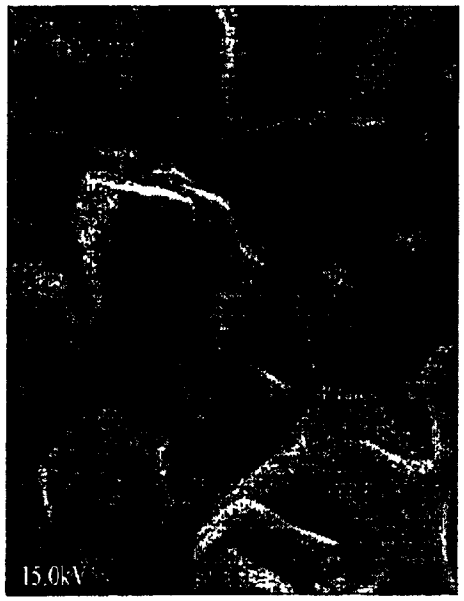
Figure 4A:
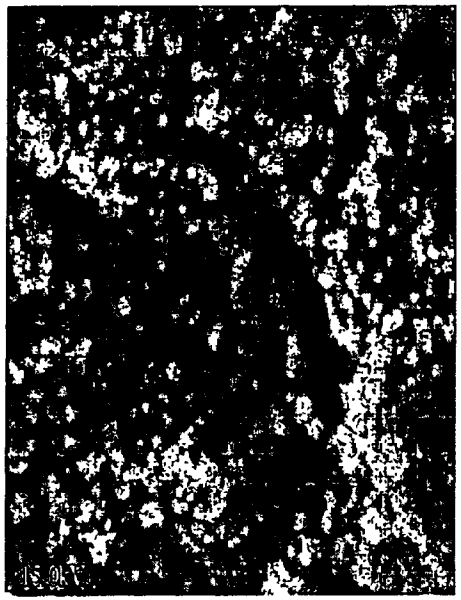

In addition, the electroless copper plating solutions of the present invention can produce copper films having resistivities of about $1.7\times10^{-6}$ to $6\times10^{-6}$ ohm cm and preferably from about $1.7\times10^{-6}$ to $5.75\times10^{-6}$ ohm cm. Not intending to be bound by theory, it appears that the low resistivities achieved using the electroless copper plating solutions can be attributed to the uniform copper deposits upon the substrate, as shown in FIGS. 4A through 4C.

An exemplary electroless copper plating solution includes copper sulfate (about 9 grams/liter), sodium hypophosphite (about 35 grams/liter), nickel sulfate (about 1–1.5 grams/liter), sodium citrate (about 25 grams/liter), boric acid (about 30 grams/liter), polyethylene glycol (about 200 parts per million), hydroxy-1-naphthalene sulfonic acid (about 150 parts per million), formamidine acetate (about 150 parts per million), butynediol (about 25 parts per million), and dipyridyl (about 10 parts per million).

Now having described the electroless copper plating solution and methods of use in general, Examples 1 and 2 will describe some embodiments of the electroless copper plating solution. While embodiments of the electroless copper plating solution are described in connection with examples 1 and 2 and the corresponding text and figures, there is no intent to limit embodiments of the electroless copper plating solution to these descriptions. On the contrary, the intent is to cover all alternatives, modifications, and equivalents included within the spirit and scope of embodiments of the present invention.

EXAMPLE 1

Example 1 discusses the use of thiourea (tu) and 1,3 diphenyl-2-thiourea (DPTU) to accelerate the electroless copper deposition process using HEDTA as the complexing agent and a hypophosphite as the reducing agent.

The composition and operating conditions of the electroless copper plating solution employed in Example 1 (less tu and DPTU) are summarized in Table 1.

TABLE 1

| | |
|---|---|
| $CuSO_4.5H_2O$ | 0.04 M |
| $NaH_2PO_2.H_2O$ | 0.12 M |
| $H_3BO_3$ | 0.48 M |
| $NiSO_4.6H_2O$ | 500 ppm |
| Polyethylene Glycol | 200 ppm |
| HEDTA | 0.08 M |
| pH | 9.3 |
| T(° C.) | 70 |

HEDTA functions as the complexing agent for the copper (II) ions avoiding $Cu(OH)_2$ precipitation, sodium hypophosphite ($NaH_2PO_2.H_2O$) is the reducing agent, boric acid buffers ($H_3BO_3$) the electrolyte, polyethylene glycol is a surfactant, and nickel sulfate ($NiSO_4.6H_2O$) improves the catalytic effect of the deposition. Deionized water was used and the pH was adjusted using NaOH or $H_2SO_4$. Epoxy boards were used as the substrates for the electroless copper deposition. The epoxy boards were activated according to the Shipley process. The Shipley process is commercially available from Shipley Company, Inc.

Figure 1B:
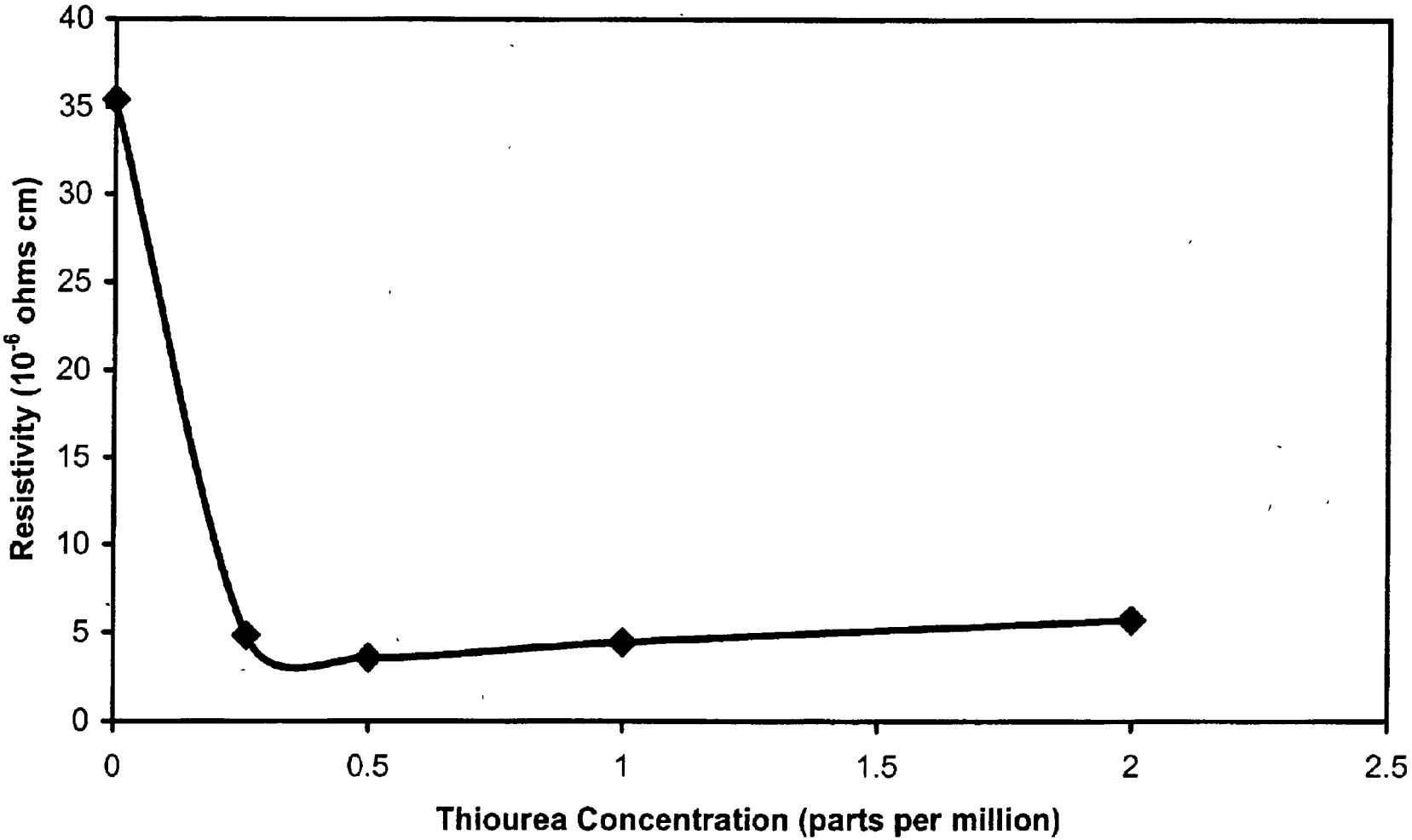
FIG. 1B is a graph illustrating the resistivity of the resulting copper film.

When tu was added into the electroless copper plating solution with HEDTA as the complexing agent and hypophosphite as the reducing agent, the deposition rate of copper plating increased significantly and the resistivity of the copper film decreased, as shown in FIGS. 1A and 1B. The color of the deposits changed from black in the absence of tu in the solution, to semi-bright at about 0.5 parts per million tu. In addition, the resistivity of the copper deposits decreased due to changes in the structure of the deposits. The darker deposits were rougher and more porous.

Figure 2A:
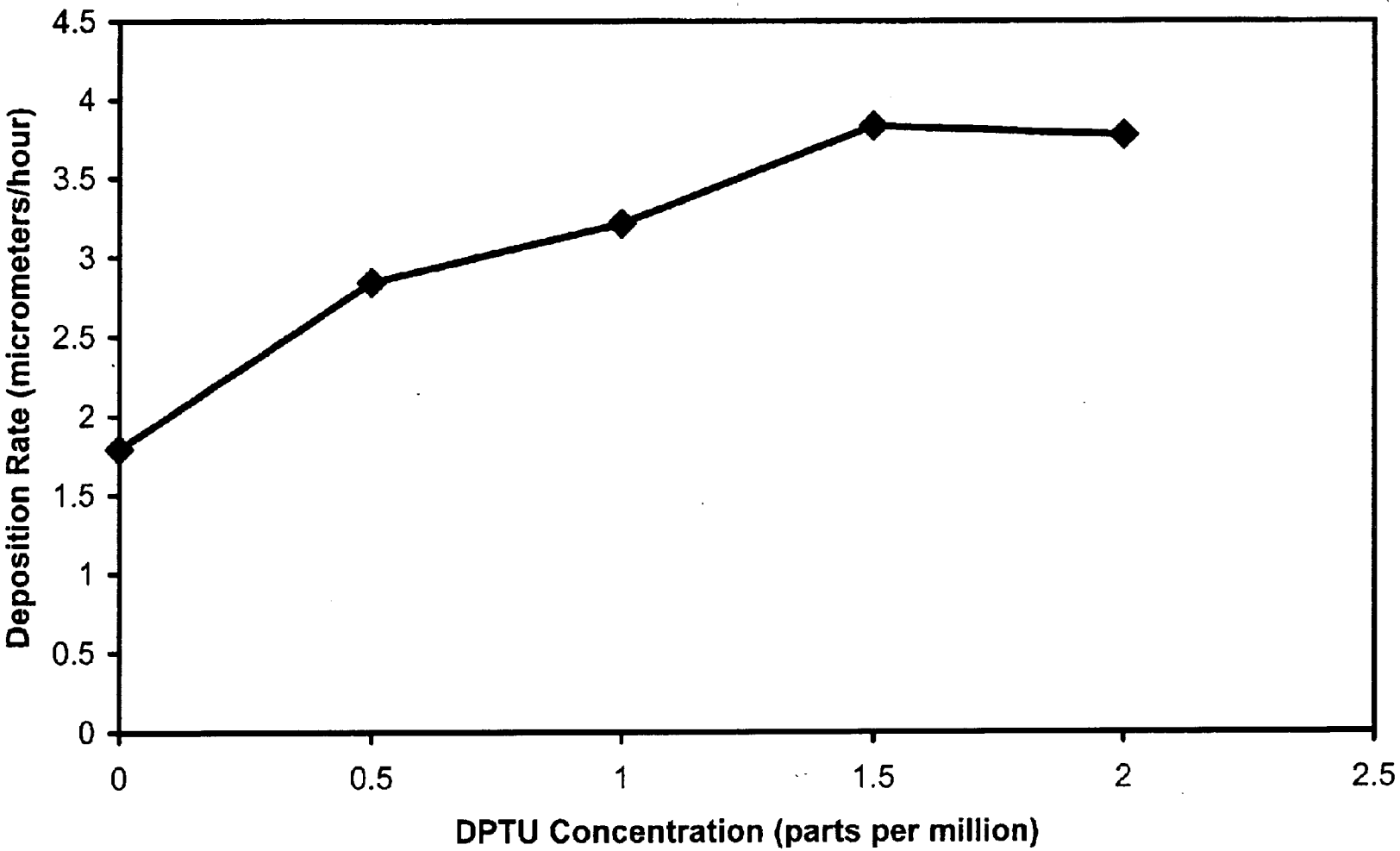
Figure 2B:
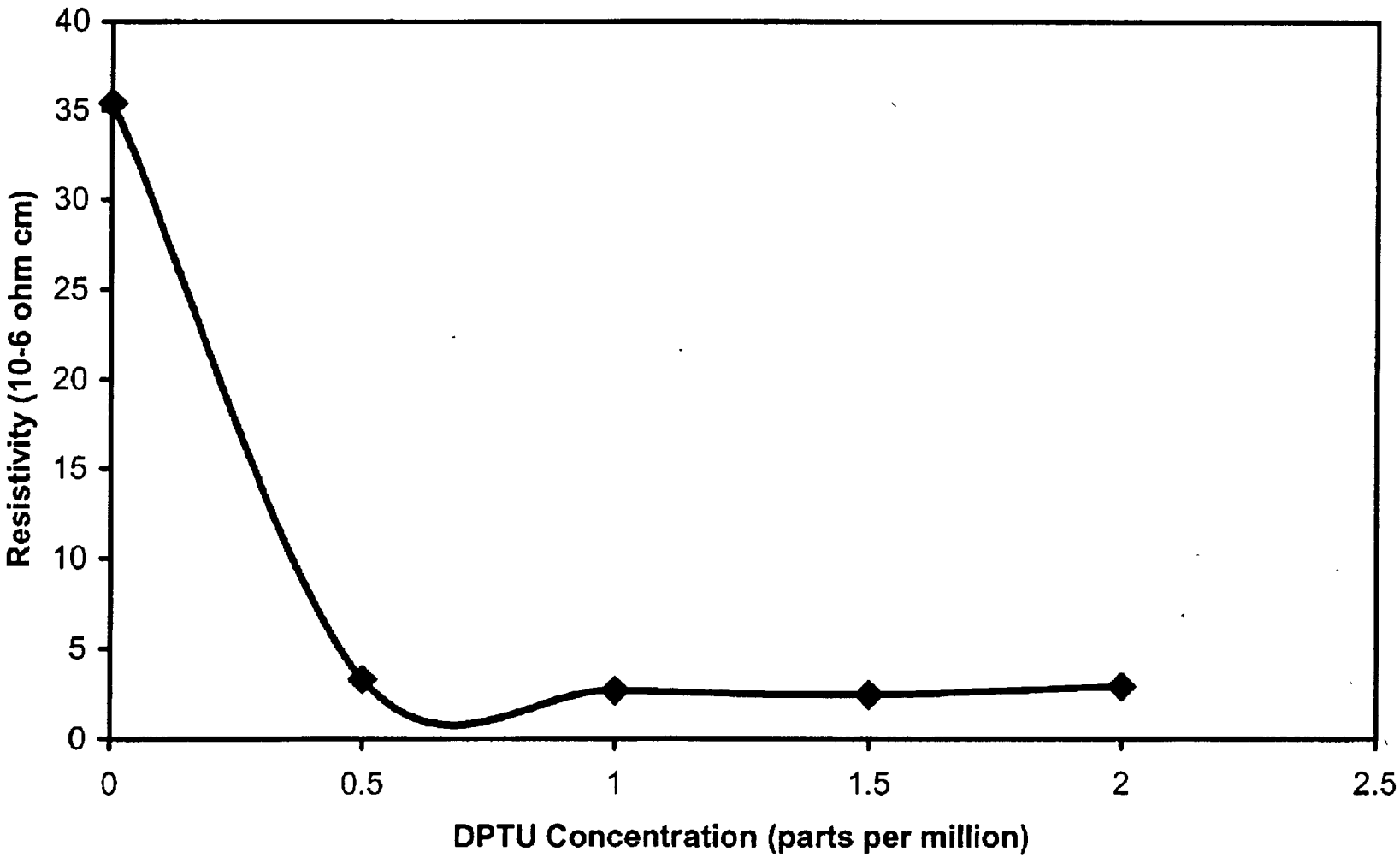
FIG. 2B is a graph illustrating the resistivity of the resulting copper film.

As shown in FIGS. 2A and 2B, DPTU had similar beneficial effects on the deposition rate as tu in the electroless copper plating solution. FIG. 2A shows the average deposition rate of the electroless copper plating solution as a function of DPTU concentration, while FIG. 2B shows the resistivity of the deposit as a function of DPTU concentration. Although the deposition rate with DPTU was less than that with tu, the resistivity of the copper deposit was lower and nearly the same as that obtained with formaldehyde-based electroless copper plating solutions. Furthermore, the deposition rate increased with DPTU concentration and the deposit appeared semi-bright at all DPTU concentrations.

Figure 3:
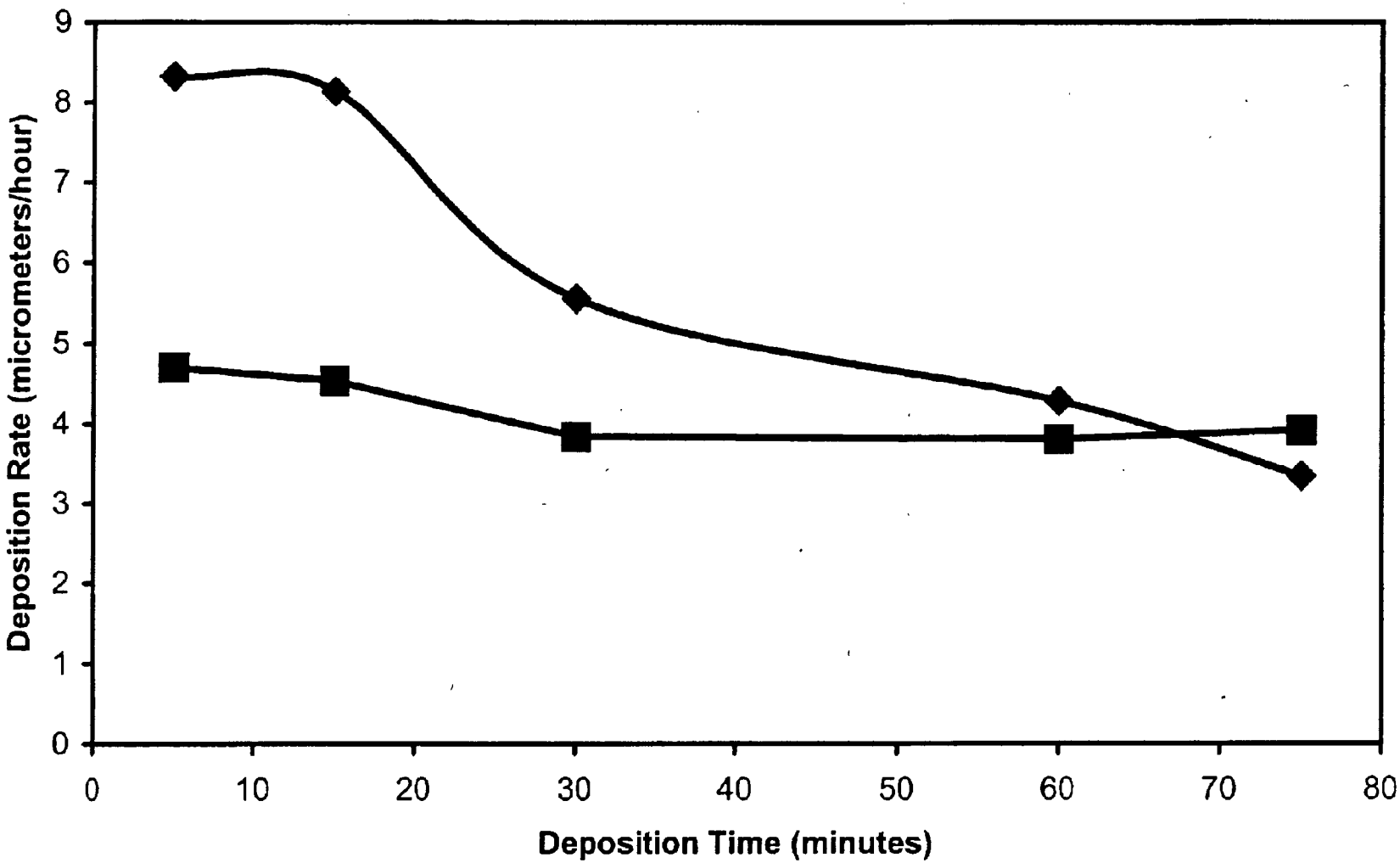
FIG. 3 is a graph illustrating the deposition rate versus time of the two representative electroless copper plating solutions shown in FIGS. 1A and 1B, and 2A and 2B.

The temporal uniformity of the electroless process was improved with both tu and DPTU. The deposition rate of the electroless copper plating solution in the absence of tu drops quickly with time once the palladium catalyst on the substrate surface is covered by deposited copper, even when nickel ions are present in the solution. The change in deposition rate with time using tu and DPTU in the solution is shown in FIG. 3. The deposition rate with about 2 parts per million tu decreased steadily with time, whereas the deposition rate with about 1.5 parts per million DPTU was more constant.

FIGS. 4A through 4C show the surface morphologies of the copper deposits from the electroless solutions with and without tu or DPTU additions. The topography of the copper deposited from the hypophosphite electroless copper plating solution was relatively rough with small growth colonies without tu and DPTU. This resulted in higher resistivity. When tu and DPTU were added in the solution, the copper deposits became more uniform and the growth colony size increased. The growth colonies of the copper from the tu solutions were larger than those from DTPU. The crystallographic orientation of the copper deposits did not change with the addition of tu and DPTU. All of deposits exhibited strong (111) texture. No nickel was detected in the copper deposits from the solutions with and without tu or DPTU additions, via XPS analysis.

Thiourea and 1,3-diphenyl-2-thiourea increase the deposition rate of electroless copper plating solutions that use HEDTA as the complexing agent and sodium hypophosphite as the reducing agent. The conductivity of deposited copper was significantly improved compared to no additive. Electrochemical measurements show that small amounts of tu or DPTU in the solution can improve the catalytic activity of copper for the oxidation of hypophosphite and decrease the polarization of the oxidation of hypophosphite, resulting in higher deposition rates.

EXAMPLE 2

Example 2 discusses the use of formamidine disulfide dihydrochloride to accelerate the electroless copper deposition process using sodium citrate as the complexing agent and a hypophosphite as the reducing agent. Thiourea or its derivatives accelerate the deposition rate in the electroless copper plating solution using HEDTA as complexing agent, while they had little effect on the deposition rate and coating properties if sodium citrate was used as the complexing agent in place of HEDTA. Thiourea is oxidized to formamidine disulfide (fd) in HEDTA-electroless copper plating solution and fd has the same function as thiourea in HEDTA-electroless copper plating solution.

The composition and operating conditions of the electroless copper solution employed in Example 2 (less fd) are summarized in Table 2. Sodium citrate is the complexing agent for chelating the copper and nickel ions, and HEDTA is added to maintain the stability of fd. The functions of other chemicals are the same as described in Example 1. Deionized water was used to prepare the solution. The pH was adjusted using NaOH or $H_2SO_4$ in the range 9.0 to 9.3.

A copper deposit with a pink-tint was obtained in a citrate-electroless copper plating solution with about 0.5 parts per million fd. The change in deposition rate of the electroless copper plating with deposition time is show in FIG. 5. It can be seen that the average deposition rate for about 30 minutes plating (about 7.15 micrometers/hour) was higher than that in the HEDTA-electroless copper plating solution using thiourea or fd as accelerators (about 5.78–6.36 micrometers per hour). As shown in FIG. 6B, the resistivity of the copper deposit was lower and nearly the same as that obtained with formaldehyde-based electroless copper plating solutions. The citrate-electroless copper plating solution had a low deposition rate in the absence of fd (about 1.27 micrometers/hour for about 30 minutes) and the copper deposit was dark once the palladium catalyst on the substrate surface was covered with copper. Thus, fd accelerates the deposition process in the citrate based electroless copper plating solution. Electrochemical measurements show that both half reactions of the oxidation of hypophosphite and reduction of copper ions are accelerated with fd.

TABLE 2

| | |
|---|---|
| $CuSO_4x5H_2O$ | 0.04 M |
| $NaH_2PO_2xH_2O$ | 0.17 M |
| Sodium citrate | 0.051 M |
| HEDTA | 0.015 M |
| $H_3BO_3$ | 0.48 M |
| $NiSO_4x6H_2O$ | 250 ppm |
| Polyethylene Glycol | 200 ppm |
| pH | 9.3 |
| T(° C.) | 72.5 |

Figure 5:
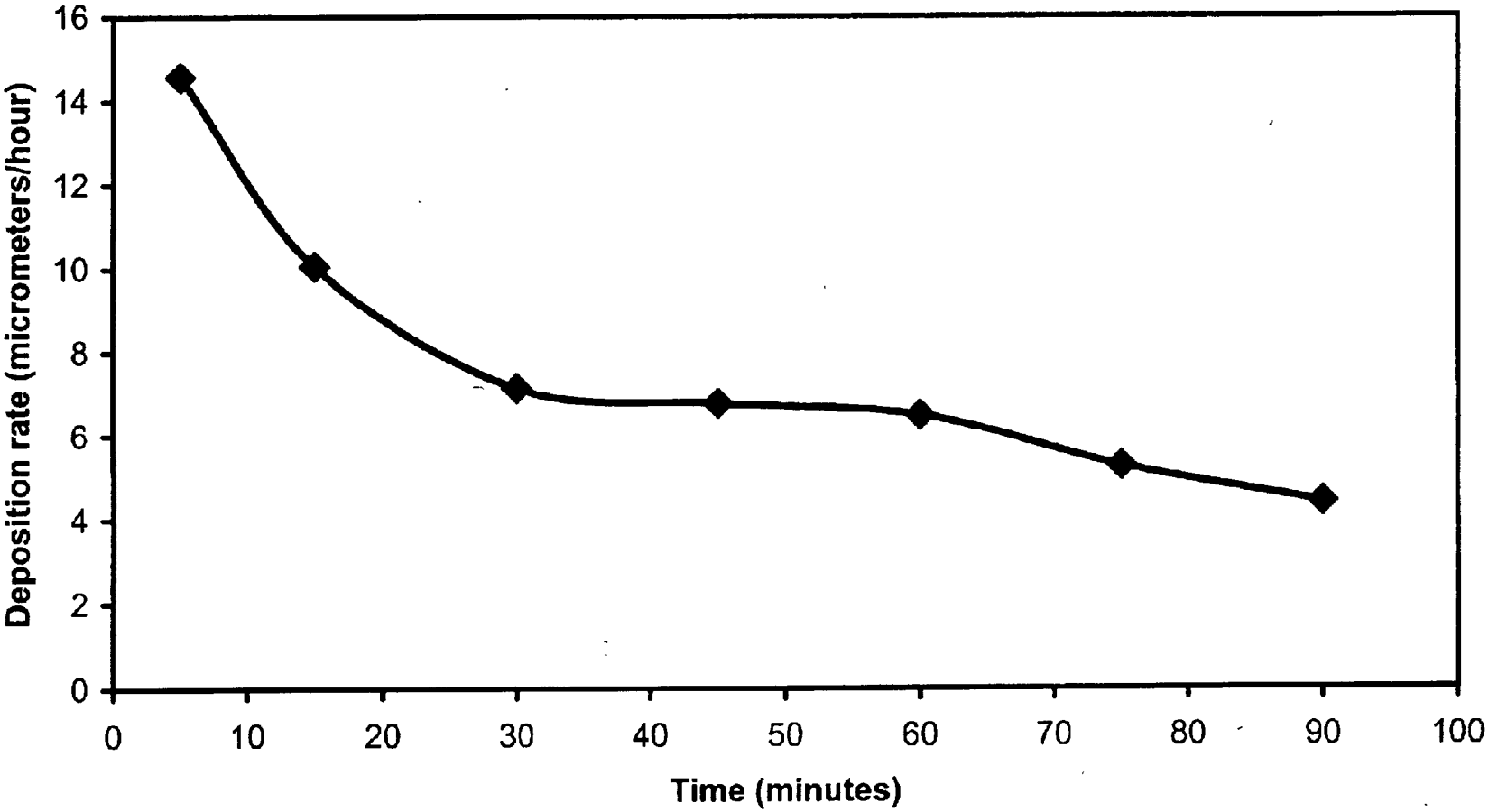
FIG. 5 is a graph illustrating the deposition rate of another representative electroless copper plating solution containing formamidine disulfide dihydrochloride.
Figure 6A:
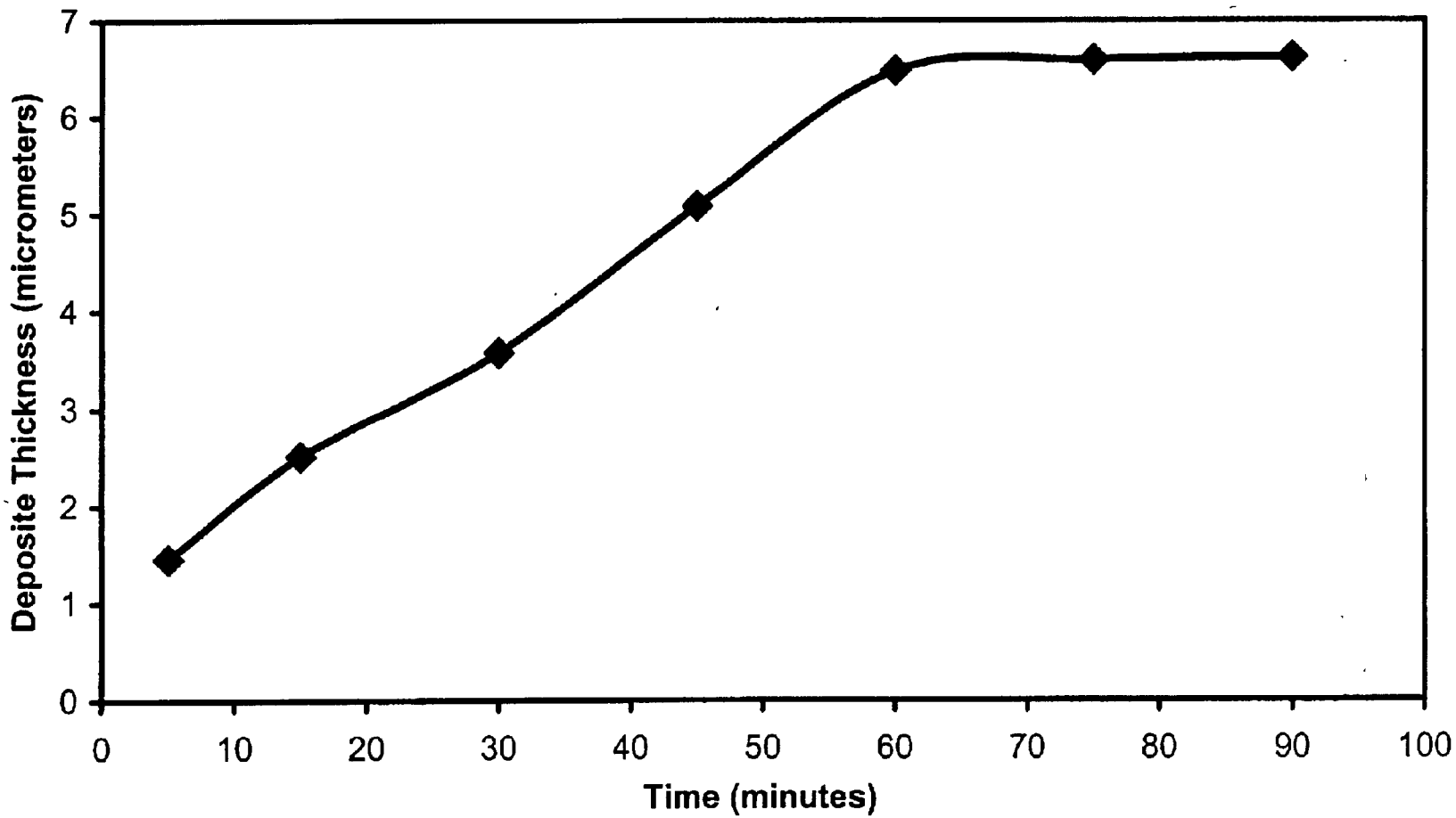
Figure 6B:
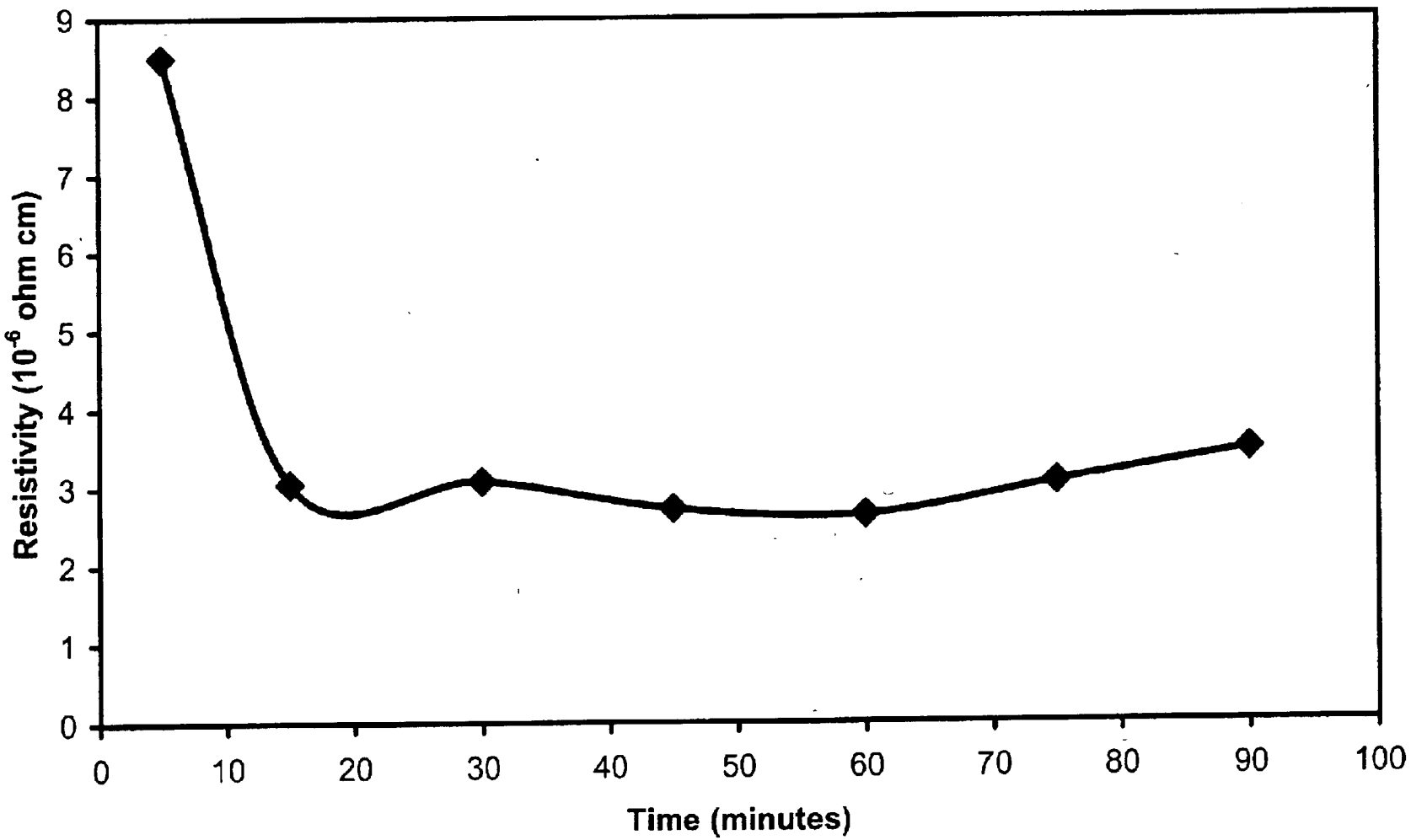
FIG. 6B illustrates the resistivity of the copper films over deposition time using the electroless copper plating solution discussed in reference to FIG. 5.

In FIG. 5, it is shown that the deposition rate of the electroless copper plating decreased steadily with time. After about 90 minutes of deposition, the reaction almost stopped and the color of the copper deposit changed from pink to dark brown. The total copper deposit thickness was about 6.48 to 6.59 micrometers as shown in FIG. 6A. The resistivity of deposited coper was at a lower value of about $2.72\times10^{-6}$ ohm cm. Obviously, the catalytic activity of the copper deposit for the oxidation of hypophosphite in the citrate-based electroless copper plating solution decreased with the deposit thickness.

The catalytic activity of the copper surface for the oxidation of hypophosphite and the linearity of the deposition rate during plating process can be improved by increasing the nickel ion concentration in the solution. The electroless copper plating was successfully applied in the high density wiring processes.

It should be emphasized that the above-described embodiments of the present invention, particularly, any "preferred" embodiments, are merely possible examples of implementations, and are merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. An electroless copper plating solution, comprising:

a copper-containing compound;

a reducing agent that is a source of hypophosphite ions;

at least one accelerator compound, wherein the accelerator compound is a source of a formamidine disulfide compound; and a (N-(2-hydroxyethyl)ethylenediaminetriacetic acid salt (HEDTA) compound, wherein the HEDTA compound, the copper-containing compound, and the accelerator compound react to form the formamidine disulfide compound, wherein the formamidine disulfide compound accelerates the oxidation of the reducing agent and the reduction of the copper-containing compound, and wherein the formamidine disulfide compound is formed in an amount to reduce copper (II) ions onto the structure as the metal film at a deposition rate from about 2 to 16 micrometers/hour.

2. The solution of claim 1, wherein the at least one accelerator compound includes the following formula, where R and R' can be selected from hydrogen, aryl groups, and aliphatic groups:

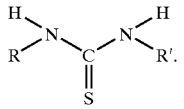

3. The solution of claim 1, wherein the least one accelerator compound is thiourea.

4. The solution of claim 1, wherein the least one accelerator compound is from about 0.5 parts per million to 250 parts per million.

5. The solution of claim 1, wherein the reducing agent includes hypophosphite salts and combinations thereof.

6. The solution of claim 1, wherein the reducing agent is from about 0.06 M to 0.45 M.

7. The electroless copper plating solution of claim 1, wherein the amount of formamidine disulfide compound is from about 0.5 to 250 parts per million.

8. A method of electroless plating, comprising:

providing a structure;

providing a electroless copper plating solution including:

a copper-containing compound, a reducing agent that is a source of hypophosphite ions, at least one accelerator compound, wherein the accelerator is a source of a formamidine disulfide compound, and a (N-(2-hydroxyethyl)ethylenediaminetriacetic acid salt (HEDTA) compound;

forming a formamidine disulfide compound by reacting the HEDTA compound, the copper-containing compound, and the accelerator compound;

exposing the structure to the electroless copper plating solution, wherein the formamidine disulfide compound accelerates the oxidation of the reducing agent and the reduction of the copper-containing compound; and reducing copper (II) ions onto the structure as a metal film, wherein the formamidine disulfide compound is formed in an amount to reduce copper (II) ions onto the structure as the metal film at a deposition rate from about 2 to 16 micrometers/hour.

9. The method of claim 8, wherein the solution has a pH from about 8 to 10.

10. The method of claim 8, wherein the solution has a pH of about 9.2.

11. The method of claim 8, wherein the at least one accelerator compound includes the following formula, where R and R' can be selected from hydrogen, aryl groups, and aliphatic groups:

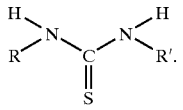

12. The method of claim 8, wherein the least one accelerator compound is thiourea.

13. The method of claim 8, wherein the reducing agent includes hypophosphite salts and combinations thereof.

14. The method of claim 8, wherein the metal film has a resistivity from about $1.7\times10^{-6}$ to $6\times10^{-6}$ ohm cm.

15. The method of claim 8, wherein the amount of formamidine disulfide compound is from about 0.5 to 250 parts per million.

16. An electroless copper plating solution, comprising:

a copper-containing compound;

a reducing agent that is a source of hypophosphite ions; and a formamidine disulfide compound, wherein the formamidine disulfide compound accelerates the oxidation of the reducing agent and the reduction of the copper-containing compound.

17. The electroless copper plating solution of claim 16, wherein the formamidine disulfide compound being present in an amount to reduce copper (II) ions onto the structure as the metal film at a deposition rate from about 2 to 16 micrometers/hour.

18. The electroless copper plating solution of claim 16, wherein the amount of formamidine disulfide compound is from about 0.5 to 250 parts per million.

19. A method of electroless plating, comprising:

providing a structure;

providing an electroless copper plating solution including:

a copper-containing compound, a reducing agent that is a source of hypophosphite ions, and a formamidine disulfide compound;

exposing the structure to the electroless copper plating solution, wherein the formamidine disulfide compound accelerates the oxidation of the reducing agent and the reduction of the copper-containing compound; and reducing copper (II) ions onto the structure.

20. The method of claim 19, wherein the providing an electroless copper plating solution further comprises providing an electroless copper plating solution wherein the formamidine disulfide compound is formed in an amount to reduce copper (II) ions onto the structure as the metal film at a deposition rate from about 2 to 16 micrometers/hour.

21. The method of claim 19, wherein the amount of formamidine disulfide compound is from about 0.5 to 250 parts per million.

* * * * *

UNITED STATES PATENT AND TRADEMARK OFFICE

CERTIFICATE OF CORRECTION

PATENT NO. : 6,875,474 B2
DATED : April 5, 2005
INVENTOR(S) : Kohl et al.

It is certified that error appears in the above-identified patent and that said Letters Patent is hereby corrected as shown below:

Column 3,
Line 20, after the word "include," insert the word -- a --.
Lines 44-45, delete "(N-(2-hydroxyethyl)" and replace with -- (N-2-hydroxyethyl) --.

Column 4,
Lines 20 and 21, delete the word "and" and replace with the word -- to --.

Column 7,
Line 36, delete the word "coper" and replace with the word -- copper --.
Line 65, delete "(N-(2-hydroxyethyl)" and replace with -- (N-2-hydroxyethyl) --.

Column 8,
Lines 22 and 24, after the word "the" insert the word -- at --.
Line 37, delete the word "a" and insert the word -- an --.
Line 44, delete "(N-(2-hydroxyethyl)" and replace with -- (N-2-hydroxyethyl) --.

Signed and Sealed this

Ninth Day of August, 2005

JON W. DUDAS
*Director of the United States Patent and Trademark Office*